US008131165B2

(12) United States Patent
Yamaguchi et al.

(10) Patent No.: US 8,131,165 B2
(45) Date of Patent: Mar. 6, 2012

(54) IMAGE FORMING APPARATUS AND WASTE POWDER TRANSPORTING METHOD

(75) Inventors: Yoji Yamaguchi, Ebina (JP); Shigeo Ohno, Ebina (JP); Tomoya Ichikawa, Ebina (JP); Mihoko Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 133 days.

(21) Appl. No.: 12/359,611

(22) Filed: Jan. 26, 2009

(65) Prior Publication Data

US 2010/0080637 A1 Apr. 1, 2010

(30) Foreign Application Priority Data

Sep. 29, 2008 (JP) ..... 2008-251804

(51) Int. Cl.
*G03G 15/00* (2006.01)
*G03G 21/12* (2006.01)

(52) U.S. Cl. ..... 399/13; 399/360

(58) Field of Classification Search ..... 399/12, 399/13, 112, 299, 341, 358, 360
See application file for complete search history.

(56) References Cited

U.S. PATENT DOCUMENTS

| | | | | |
|---|---|---|---|---|
| 5,933,690 | A * | 8/1999 | Sugimoto et al. | 399/358 X |
| 6,029,018 | A * | 2/2000 | Rogers et al. | 399/12 |
| 6,678,493 | B2 * | 1/2004 | Maeyama et al. | 399/341 X |
| 7,058,348 | B2 * | 6/2006 | Aslam et al. | 399/341 |
| 2006/0104663 | A1 * | 5/2006 | Kitozaki | 399/111 |
| 2006/0251450 | A1 * | 11/2006 | Murayama et al. | 399/299 |

FOREIGN PATENT DOCUMENTS

| | | |
|---|---|---|
| JP | UM-A-02-119281 | 9/1990 |
| JP | 09-212053 | 8/1997 |
| JP | 10-010866 | 1/1998 |
| JP | 10-153933 | 6/1998 |
| JP | 2000-035703 | 2/2000 |
| JP | 2002-6711 | 1/2002 |
| JP | 2002-236392 | 8/2002 |
| JP | 2003-162125 | 6/2003 |
| JP | 2003-173060 | 6/2003 |
| JP | 2005-055483 | 3/2005 |
| JP | 2006-091457 | 4/2006 |
| JP | 2006-263938 | 10/2006 |
| JP | 2007-155963 | 6/2007 |
| JP | 2007-199197 | 8/2007 |
| JP | 2008-112087 | 5/2008 |

* cited by examiner

*Primary Examiner* — Sandra Brase
(74) *Attorney, Agent, or Firm* — Morgan, Lewis & Bockius LLP

(57) ABSTRACT

An image forming apparatus includes: an image forming section including first and second image forming parts each forming a toner image by using an image forming unit to be mounted, the first and the second image forming parts being inhibited from forming respective toner images if an image forming unit is not mounted to the first image forming part, the first image forming part being allowed to form a toner image if an image forming unit is mounted to the first image forming part while an image forming unit is not mounted to the second image forming part; and a transporting section including first and second receiving parts receiving waste powder discarded by the first and second image forming parts, respectively, and that transports the received waste powder. The second receiving part is provided downstream of the first receiving part in a transporting direction of the waste powder.

10 Claims, 4 Drawing Sheets

IMAGE FORMING APPARATUS AND WASTE POWDER TRANSPORTING METHOD

CROSS REFERENCE TO RELATED APPLICATIONS

This application is based on and claims priority under 35 USC §119 from Japanese Patent Application No. 2008-251804 filed Sep. 29, 2008.

BACKGROUND

1. Technical Field

The present invention relates to an image forming apparatus and a waste powder transporting method.

2. Related Art

As the image forming apparatus, there is known a so-called tandem-type image forming apparatus, for example, in which multiple image forming units respectively storing toners of colors different from each other are aligned with one another along an intermediate transfer belt. In the image forming apparatus of this type, a toner remaining on a photoconductor of each image forming unit is removed by a cleaner, and then is transported to a waste toner box.

SUMMARY

According to an aspect of the present invention, there is provided an image forming apparatus including: an image forming section that includes a first image forming part forming a toner image by using an image forming unit to be mounted, and a second image forming part forming a toner image by using an image forming unit to be mounted, the first image forming part and the second image forming part being inhibited from forming respective toner images if an image forming unit is not mounted to the first image forming part, the first image forming part being allowed to form a toner image if an image forming unit is mounted to the first image forming part while an image forming unit is not mounted to the second image forming part; and a transporting section that includes a first receiving part receiving waste powder discarded by the first image forming part, and a second receiving part receiving waste powder discarded by the second image forming part, and that transports the waste powder thus received, the second receiving part of the transporting section being provided downstream of the first receiving part in a transporting direction of the waste powder.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described in detail below with reference to the accompanying drawings.

Figure 1:
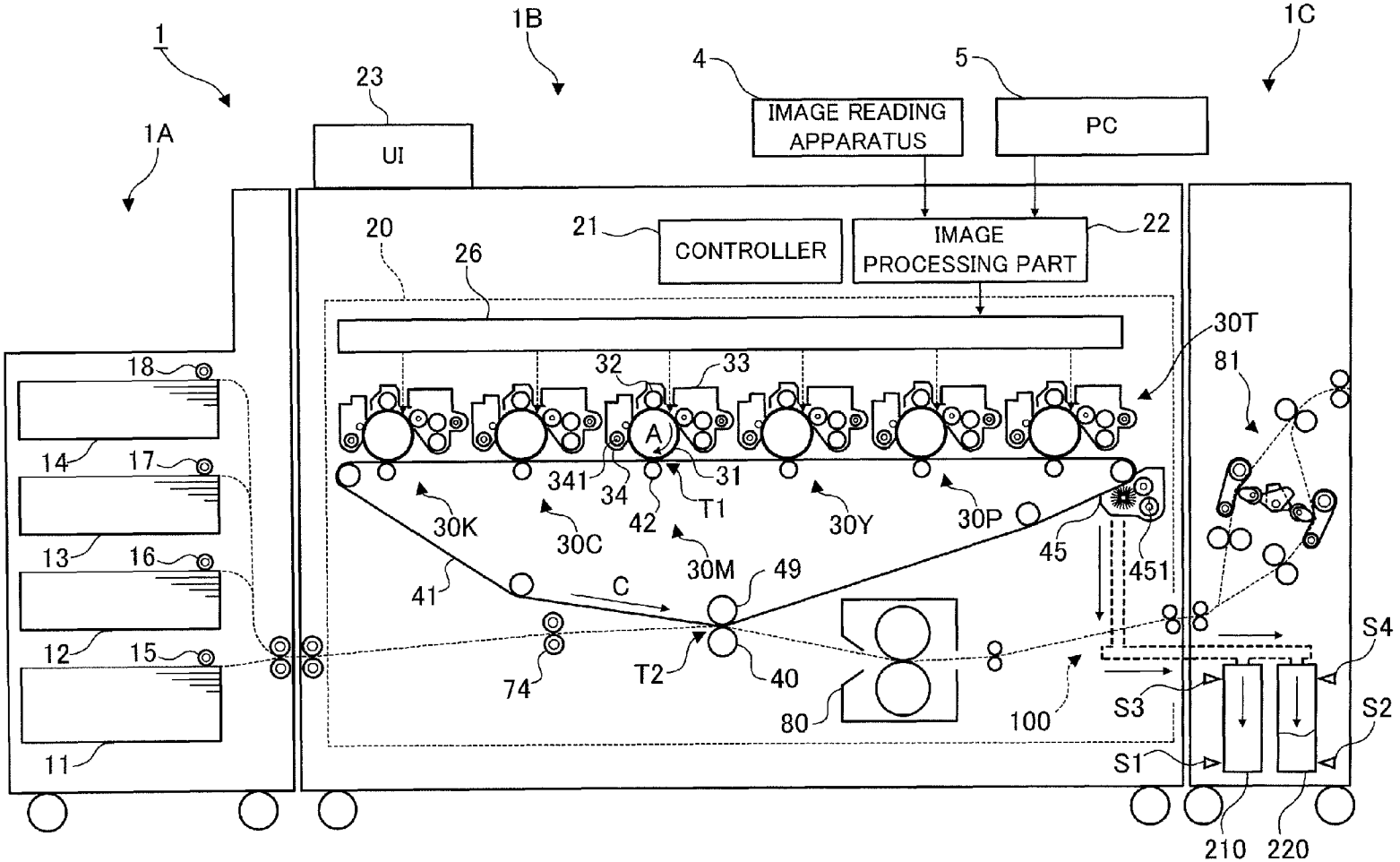
FIG. 1 is a diagram showing a configuration of a digital color printer as an example of an image forming apparatus.

FIG. 1 is a diagram showing a configuration of a digital color printer as an example of an image forming apparatus to which the exemplary embodiment is applied.

The image forming apparatus 1 of the present exemplary embodiment includes a sheet feeding unit 1A, an image formation unit 1B, and a sheet outputting unit 1C.

The sheet feeding unit 1A includes a first sheet storage part 11 to a fourth sheet storage part 14, each of which stores paper sheets serving as an example of a recording medium. The sheet feeding unit 1A further includes sending rolls 15 to 18 provided respectively for the first to fourth sheet storage parts 11 to 14. The sending rolls 15 to 18 send paper sheets stored in the respective sheet storage parts 11 to 14 to transport paths each connected to the image formation unit 1B.

The image formation unit 1B is of a so-called tandem type, and includes an image forming process part 20, a controller 21, and an image processing part 22. The image forming process part 20 forms an image on a paper sheet. The controller 21 controls the image forming process part 20 and the like. The image processing part 22 is connected, for example, to an image reading apparatus 4 and a personal computer (PC) 5, and performs image processing on image data received from these devices. The image formation unit 1B further includes a user interface (UI) 23 that has a display device and the like, and that gives information to the user and receives information inputted by the user.

Six image forming units 30T, 30P, 30Y, 30M, 30C, and 30K (hereinafter, sometimes referred to simply as "image forming units 30") arranged in parallel at intervals are mounted to the image forming process part 20. Each image forming unit 30 includes a photoconductor drum 31, a charging roll 32, a developing device 33, and a cleaning unit 34. An electrostatic latent image is formed on the photoconductor drum 31 while the photoconductor drum 31 is rotating in a direction indicated by a narrow A in the figure. The charging roll 32 electrically charges a surface of the photoconductor drum 31 uniformly. The developing device 33 develops the electrostatic latent image formed on the photoconductor drum 31. The cleaning unit 34 removes an untransferred toner and the like on the surface of the photoconductor drum 31. In addition, the image forming process part 20 is provided with a laser exposure device 26 that scans and exposes, with a laser beam, the photoconductor drums 31 of the respective image forming units 30T, 30P, 30Y, 30M, 30C, and 30K.

Here, all the image forming units (toner-image forming units) 30 have almost the same configuration except for the toner stored in the respective developing devices 33. Yellow (Y), magenta (M), cyan (C), and black (K) toner images are formed in the image forming units 30Y, 30M, 30C, and 30K, respectively. For this reason, the image forming units 30Y, 30M, 30C, and 30K may be taken respectively as a Y-color toner image forming unit (Y-color image forming unit) that forms a yellow toner image, a M-color toner image forming unit (M-color image forming unit) that forms a magenta toner image, a C-color toner image forming unit (C-color image forming unit) that forms a cyan toner image, and a K-color toner image forming unit (K-color image forming unit) that forms a black toner image. Moreover, for example, a part where the image forming unit 30Y is mounted may be taken as a first image forming part.

Meanwhile, in addition to the commonly-used four colors (normal colors), that is, yellow, magenta, cyan, and black, another image forming material is sometimes desired to be used in the forming of an image on a paper sheet. Specifically, there is a case where an image is desired to be formed on a paper sheet by using an image forming material, such as a spot color, that is difficult or impossible to be expressed with the commonly-used four colors. For example, an image is sometimes desired to be formed on a paper sheet by using a toner, such as a toner of a corporate color dedicated to a specific user, a foam toner for Braille, a fluorescent toner, a toner (a clear toner) that improves a gloss, a ferromagnetic toner, an invisible toner having sensitivity to the infrared region, or the like. Moreover, there is also a case where a toner that improves transferability, in addition to the yellow, magenta, cyan and black toners, is desired to be further superposed on to these toners in order to improve transferability of these toners onto a paper sheet.

For this reason, the image formation unit 1B of the present exemplary embodiment is provided with image forming units 30T and 30P that achieve image formation using a spot color and the like, in addition to the generally-mounted image forming units 30Y, 30M, 30C, and 30K.

Here, in the present exemplary embodiment, the image forming units 30 are provided in the following order: the image forming units 30T, 30P, 30Y, 30M, 30C, and 30K, from the upstream side to the downstream side in a direction in which an intermediate transfer belt 41 (which will be described later) moves. In addition, each image forming unit 30 is detachably (replaceably) provided.

Incidentally, if any of the image forming units 30Y, 30M, 30C, and 30K is not mounted, an image forming process as requested is often difficult to perform. In this case, the controller 21 in the present exemplary embodiment thus inhibits any image formation by the image forming process part 20. On the other hand, even if any of the image forming units 30T and 30P is not mounted, an image forming process using the commonly-used colors is still performable. In this case, the controller 21 does thus not inhibit image formation by the image forming process part 20. Accordingly, image formation using the image forming units 30Y, 30M, 30C, and 30K is allowed to be performed.

Here, a part where the image forming unit 30P is mounted may be taken as a second image forming part. In addition, apart where the image forming unit 30T is mounted may be taken as a third image forming part.

Moreover, the image forming process part 20 includes the intermediate transfer belt 41 (an example of a transferring member or a transfer section), primary transfer rolls 42, a secondary transfer roll 40, a belt cleaner 45, and a fixing device 80. Onto the intermediate transfer belt 41, various color toner images formed by the photoconductor drums 31 of the respective image forming units 30 are superimposedly transferred. The primary transfer rolls 42 sequentially transfer (primarily transfer) the various color toner images of the respective image forming units 30 onto the intermediate transfer belt 41 at a primary transfer portion T1. The secondary transfer roll 40 transfers (secondarily transfers) the superimposed toner images, which have been transferred onto the intermediate transfer belt 41, together onto a paper sheet at a secondary transfer portion T2. The belt cleaner 45 removes an untransferred toner and the like on the surface of the intermediate transfer belt 41. The fixing device 80 fixes a secondarily transferred image onto the paper sheet.

The image forming process part 20, which is an example of an image forming section, performs an image forming operation on the basis of control signals sent from the controller 21. First, image data inputted through the image reading apparatus 4 or the PC 5 are subjected to image processing by the image processing part 22, and then supplied to the laser exposure device 26. Then, for example, in the magenta (M) image forming unit 30M, after the surface of the photoconductor drum 31 is uniformly charged with a potential set in advance, by the charging roll 32, the photoconductor drum 31 is scanned and exposed by the laser exposure device 26 with a laser beam modulated according to the image data acquired from the image processing part 22. In this way, an electrostatic latent image is formed on the photoconductor drum 31. The electrostatic latent image thus formed is developed by the developing device 33, so that a magenta toner image is formed on the photoconductor drum 31. In the same manner, yellow, cyan, and black toner images are formed respectively in the image forming units 30Y, 30C, and 30K, and also, toner images of spot colors or the like are formed respectively in the image forming units 30T and 30P.

These color toner images having been formed in the respective image forming units 30 are electrostatically transferred (primarily transferred) in sequence by the corresponding primary transfer rolls 42 onto the intermediate transfer belt 41 rotating in a direction indicated by an arrow C in FIG. 1, so that superimposed toner images are formed on the intermediate transfer belt 41. On the other hand, the untransferred toner and the like remaining on each photoconductor drum 31 at the primary transfer are removed by the cleaning unit 34 disposed downstream of the primary transfer roll 42. Each cleaning unit 34 includes a transporting member 341 provided along an axial direction of the photoconductor drum 31. The transporting member 341 transports the removed untransferred toner and the like to a rear side (back part side) of the image formation unit 1B. The untransferred toner and the like transported by the transporting member 341 to the rear side of the image formation unit 1B are then transported by a transporting mechanism 100 to a first storing container 210 or a second storing container 220. Here, the transporting mechanism 100 is provided also in the rear side of the image formation unit 1B, while the first and second storing containers 210 and 220 are both detachably and attachably provided in the sheet outputting unit 1C.

Here, in the present exemplary embodiment, two storing containers are provided. Specifically, the two storing containers are the first storing container 210 and the second storing container 220. Accordingly, for example, even if any one of the storing containers is filled up, this configuration allows an image forming operation to be continuously performed by transporting the untransferred toner and the like to the other one of the storing containers. Moreover, for example, this configuration also allows a reduction in weight of the storing container that contains the untransferred toner and the like therein when the storing container is detached, as compared with a configuration in which the untransferred toner and the like are stored in a single storing container having a large capacity.

In addition, in the present exemplary embodiment, a first sensor S1 and a second sensor S2 are provided. The first sensor S1 performs detection on the first storing container 210, while the second sensor S2 performs detection on the second storing container 220. In the present exemplary embodiment, a third sensor S3 is further provided. The third sensor S3 outputs a signal set in advance, when the untransferred toner and the like reach an upper portion of the first storing container 210 (when the first storing container 210 is filled up with the untransferred toner and the like). Furthermore, in the present exemplary embodiment, a fourth sensor S4 is provided. The fourth sensor S4 outputs a signal set in advance, when the untransferred toner and the like reach an upper portion of the second storing container 220 (when the second storing container 220 is filled up with the untransferred toner and the like).

Note that, although the first storing container 210 and the second storing container 220 are provided in the sheet outputting unit 1C in the present exemplary embodiment, these storing containers may be provided alternatively in the image formation unit 1B.

On the other hand, the superimposed toner images formed on the intermediate transfer belt 41 are transferred, according to the movement of the intermediate transfer belt 41, toward the secondary transfer portion T2 in which the secondary transfer roll 40 and a backup roll 49 are disposed. Meanwhile, the paper sheet is transferred to a position of a registration roll 74 after being taken out of, for example, the first sheet storage part 11 by the sending roll 15 and then passing through the transport path.

At the timing when the superimposed toner images are transported to the secondary transfer portion T2, the paper sheet is fed to the secondary transfer portion T2 from the registration roll 74. Then, the superimposed toner images are electrostatically transferred (secondarily transferred) together onto the paper sheet by the action of a transfer electric field formed between the secondary transfer roll 40 and the backup roll 49 at the secondary transfer portion T2.

Thereafter, the paper sheet having the superimposed toner images electrostatically transferred thereon is peeled from the intermediate transfer belt 41, and then, is transported to the fixing device 80. The unfixed toner images on the paper sheet having been transported to the fixing device 80 are subjected to a fixing process with heat and pressure by the fixing device 80 so as to be fixed onto the paper sheet. Then, the paper sheet having a fixed image formed thereon passes through a curl correcting part 81 provided in the sheet outputting unit 1C, and then, is transported to an outputted-sheet stacking unit (not shown in the figure).

On the other hand, the untransferred toner and the like remaining on the surface of the intermediate transfer belt 41 after the secondary transfer are removed by the belt cleaner 45, which is disposed in contact with the intermediate transfer belt 41, after the completion of the secondary transfer. The belt cleaner 45 includes a transporting member 451 that is provided to extend from the front side to the rear side of the image formation unit 1B, and that transports the untransferred toner and the like thus removed to the rear side of the image formation unit 1B. Then, the untransferred toner and the like transported to the rear side of the image formation unit 1B by the transporting member 451 are transported to the first storing container 210 or the second storing container 220 by the transporting mechanism 100. Note that, in the specification, the untransferred toner and the like transported from the cleaning unit 34 and the belt cleaner 45 to the transporting mechanism 100 are hereinafter referred to as a waste toner.

Subsequently, the transporting mechanism 100 will be described in detail.

Figure 2:
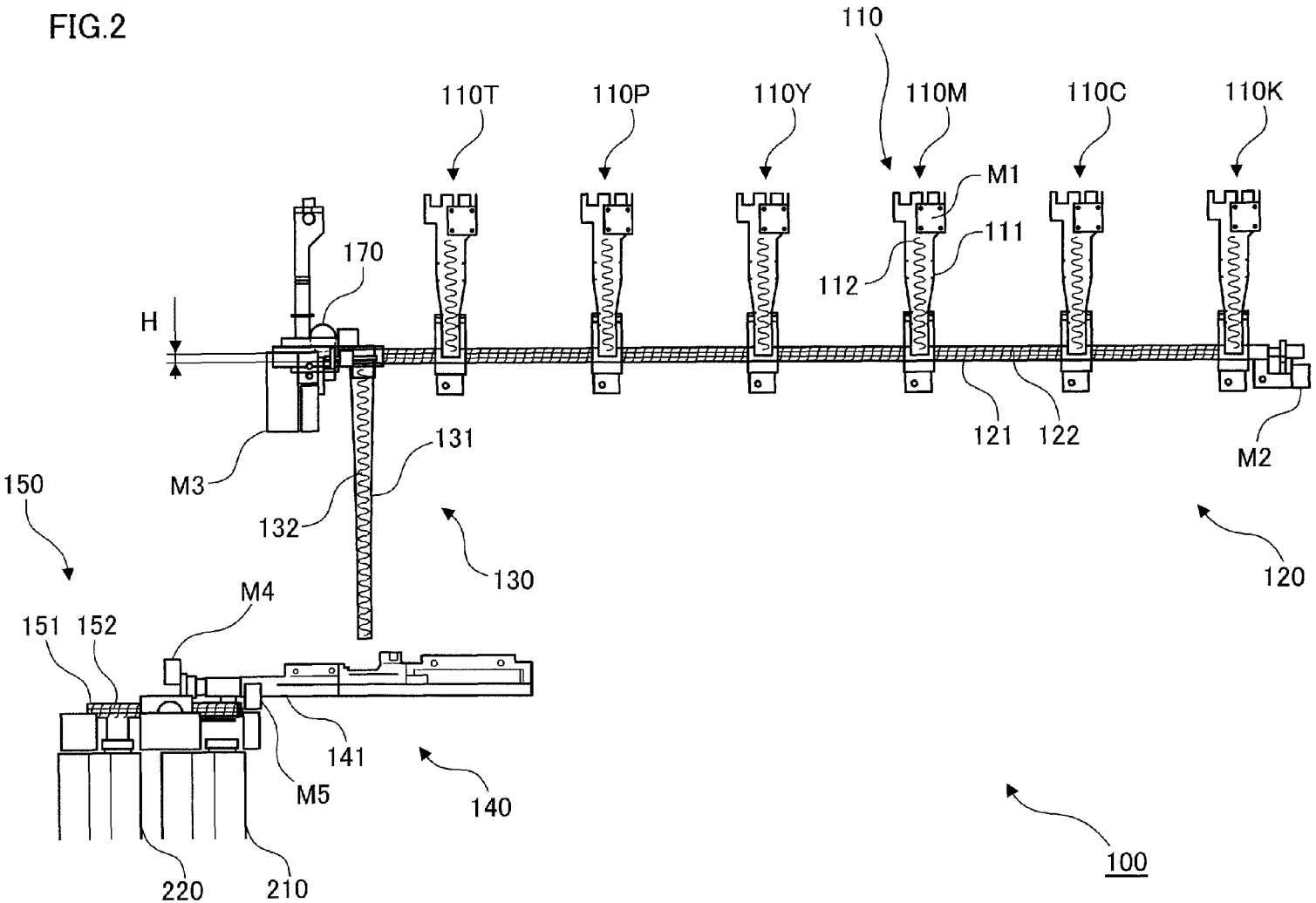
FIG. 2 is a diagram showing the transporting mechanism from the rear side of the image forming apparatus.

FIG. 2 is a diagram showing the transporting mechanism 100 from the rear side of the image forming apparatus 1.

As shown in FIG. 2, the transporting mechanism 100 includes first transporting mechanisms 110 that are provided corresponding to the respective image forming units 30, and that transport the waste toner (a waste powder) from the cleaning units 34. In addition, the transporting mechanism 100 includes a discharging part 170 to which the waste toner from the belt cleaner 45 (the waste toner (the waste powder) having been transported by the transporting member 451) is discharged. Moreover, the transporting mechanism 100 includes a second transporting mechanism 120, a third transporting mechanism 130, a fourth transporting mechanism 140, and a fifth transporting mechanism 150. The second transporting mechanism 120 transports (recovers) the waste toner having been transported by the first transporting mechanisms 110 and the waste toner having been discharged (having fallen down) from the discharging part 170. The third transporting mechanism 130 transports the waste toner having been transported by the second transporting mechanism 120. The fourth transporting mechanism 140 transports the waste toner having been transported by the third transporting mechanism 130, and the fifth transporting mechanism 150 transports, to the first storing container 210 or the second storing container 220, the waste toner having been transported by the fourth transporting mechanism 140.

Each first transporting mechanism 110 includes a tubular member 111, a coil spring 112, and a first motor M1. The tubular member 111 forms a transport path for the waste toner having been transported by the transporting member 341 (see FIG. 1) provided to the cleaning unit 34. The coil spring 112, which is an example of a breaking member, is provided inside the tubular member 111 and breaks down the waste toner adhering to an inner wall surface of the tubular member 111 by reciprocating along the tubular member 111. The first motor M1 rotationally drives the transporting member 341 and causes the coil spring 112 to reciprocate.

Each tubular member 111 is provided to extend in the up and down direction (the approximately vertical direction). Accordingly, the waste toner having been transported by the transporting member 341 falls down inside this tubular member 111.

Each coil spring 112 is formed of a wire, and has a helical (coil) shape. Specifically, each coil spring 112 does not have a rotational shaft unlike a transporting member 122 (see FIG. 4) having a rotational shaft 122A, which will be described later, and has a shape allowing the waste toner to pass through the center portion thereof. In other words, the shape of each coil spring 112 allows the waste toner to fall down in the tubular member 111. Each coil spring 112 is caused to reciprocate inside the tubular member 111 by the first motor M1 so as to break down the waste toner having set inside the tubular member 111 or to remove the waste toner from the inner wall of the tubular member 111.

The second transporting mechanism 120, functioning as a transporting section, includes a tubular member 121. The tubular member 121 is disposed to extend in an arrangement direction of the image forming units 30T, 30P, 30Y, 30M, 30C, and 30K (in the horizontal direction, approximately), is connected to the tubular members 111 and the discharging part 170, and forms a transport path for the waste toner (a recovery path for the waste toner). In addition, the second transporting mechanism 120 further includes the transporting member 122 and a second motor M2. The transporting member 122 is disposed inside the tubular member 121, and transports the waste toner having been transported from the first transporting mechanisms 110 and the waste toner having been discharged from the discharging part 170. The second motor M2 rotationally drives the transporting member 122.

The tubular member 121 includes: multiple receiving parts (receiving parts for units) that receive the waste toner from the respective tubular members 111; and a receiving part (a transfer-member receiving part) that receives the waste toner from the discharging part 170. In addition, the tubular member 121 includes a discharge outlet 121A (which will be described later; see FIG. 4) provided in a portion between the receiving part that receives the waste toner from the discharging part 170 and the group of the receiving parts that receive the waste toner from the respective tubular members 111. The discharge outlet 121A serves as a discharging part through which the waste toner inside the tubular member 121 is discharged to the third transporting mechanism 130.

Note that, one of the multiple receiving parts, which receives the waste toner from the tubular member 111 in the first transporting mechanism 110Y (which will be described later), for example, may be taken as a first receiving part. Another one of the multiple receiving parts, which receives the waste toner from the tubular member 111 in the first transporting mechanism 110P (which will be described later), may be taken as a second receiving part. Further one of the multiple receiving parts, which receives the waste toner from the tubular member 111 in the first transporting mechanism 110T (which will be described later), may be taken as a third receiving part.

The third transporting mechanism 130 includes a tubular member 131 that is provided to extend in the up and down direction (the approximately vertical direction), that is connected to the tubular member 121, and that forms a transport path for the waste toner. In addition, the third transporting mechanism 130 includes a coil spring 132 and a third motor M3. The coil spring 132 is provided inside the tubular member 131, and is reciprocatable along the tubular member 131. The third motor M3 causes the coil spring 132 to reciprocate. Note that, the transport path formed by the tubular member 131 may be taken as a second transport path into which the waste toner is transported, the waste toner having been discharged from the transport path for the waste toner, which is formed by the tubular member 121.

The tubular member 131 is provided to extend in the up and down direction (the approximately vertical direction). Accordingly, the waste toner having been transported by the second transporting mechanism 120 falls down inside this tubular member 131.

The coil spring 132 is formed of a wire, and also has a helical (coil) shape, as in the case of the coil spring 112. In addition, the coil spring 132 does not have a rotational shaft, and has a shape allowing the waste toner to pass through the center portion thereof, as in the above-described case. In other words, the shape of the coil spring 132 allows the waste toner to fall down in the tubular member 131. The coil spring 132 is caused to reciprocate inside the tubular member 131 by the third motor M3 so as to break down the waste toner having set inside the tubular member 31 or to remove the waste toner from the inner wall of the tubular member 131.

Figure 3:
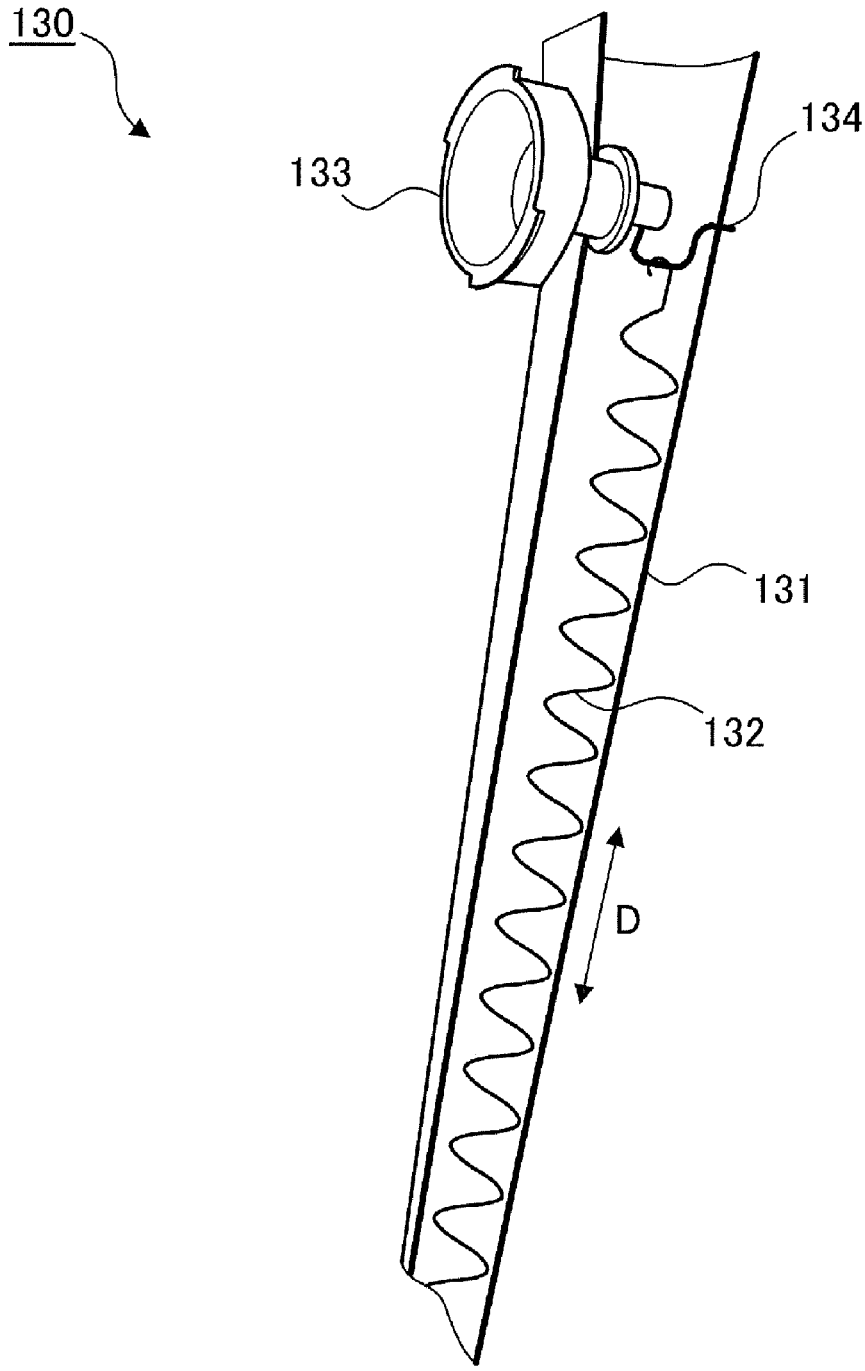
FIG. 3 is a diagram showing a reciprocation mechanism that causes the coil spring to reciprocate.

Note that, the reciprocation of the coil spring 132 is achieved by, for example, a configuration shown in FIG. 3.

Here, FIG. 3 is a diagram showing a reciprocation mechanism that causes the coil spring 132 to reciprocate. As shown in FIG. 3, the third transporting mechanism 130 includes a rotating member 133 and a driving member 134. The rotating member 133 is rotated by the third motor M3 (see FIG. 2). One end portion of the driving member 134 is attached to the rotating member 133, while an upper end portion of the coil spring 132 is attached to the driving member 134. The driving member 134 is formed in a crank shape. In addition, the driving member 134 is configured so that an attachment portion thereof to which the coil spring 132 is attached passes a position eccentric to the center of the axis of the rotating member 133 when the third motor M3 is driven. Accordingly, once the third motor M3 is started to be driven, the coil spring 132 is caused to reciprocate along the tubular member 131 (see an arrow D) by the driving member 134. Note that, although a description has been omitted above, each of the coil springs 112 in the first transporting mechanisms 110 (see FIG. 2) is also caused to reciprocate by the same mechanism as that shown in FIG. 3.

Referring back to FIG. 2 again, the transporting mechanism 100 will be further described.

The fourth transporting mechanism 140 includes a tubular member 141 that forms a transport path for the waste toner. The tubular member 141 is disposed to intersect (to be orthogonal to) the tubular member 131 in the third transporting mechanism 130. In other words, the tubular member 141 is arranged to extend in the approximately horizontal direction. Moreover, although not illustrated, the fourth transporting mechanism 140 includes a transporting member that is disposed inside the tubular member 141, and that transports the waste toner from the third transporting mechanism 130. Further, the fourth transporting mechanism 140 includes a fourth motor M4 that rotationally drives this transporting member.

The fifth transporting mechanism 150 includes a tubular member 151 that forms a transport path for the waste toner. The tubular member 151 is disposed below the tubular member 141 in the fourth transporting mechanism 140, and also is arranged parallel to the tubular member 141. The fifth transporting mechanism 150 further includes a transporting member 152 and a fifth motor M5. The transporting member 152 is disposed inside the tubular member 151, and transports the waste toner from the fourth transporting mechanism 140. The fifth motor M5 rotationally drives the transporting member 152. The fifth transporting mechanism 150 transports, to the first storing container 210 or the second storing container 220, the waste toner having been transported from the fourth transporting mechanism 140.

Figure 4:
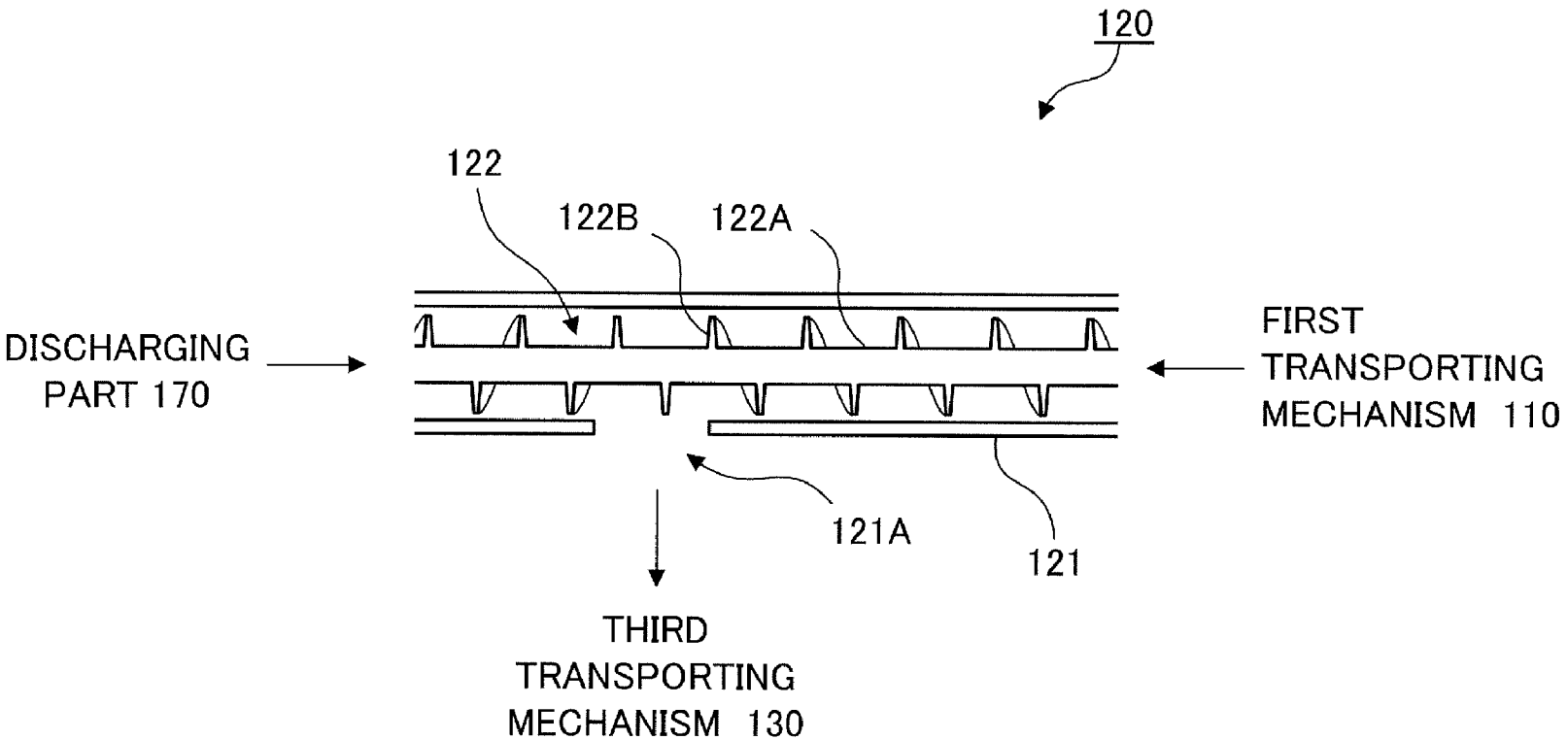
FIG. 4 is an enlarged diagram showing a part of the second transporting mechanism.

Here, FIG. 4 is an enlarged diagram showing a part of the second transporting mechanism 120. As described above, the second transporting mechanism 120 includes the tubular member 121 that forms the transport path for the waste toner. In addition, the second transporting mechanism 120 includes the transporting member 122 that is disposed inside the tubular member 121, and that transports the waste toner having been transported from the first transporting mechanisms 110 and the waste toner having been discharged from the discharging part 170.

The tubular member 121 includes, in a lower portion thereof, the discharge outlet 121A through which the waste toner having been transported by the transporting members 122 from the respective first transporting mechanisms 110 and the waste toner having been transported from the discharging part 170 are discharged to the third transporting mechanism 130.

The transporting member 122 includes: the rotational shaft 122A that is rotated by the second motor M2 (see FIG. 2); and ridge portions 122B that is provided to protrude from the rotational shaft 122A. The ridge portions 122B are provided on the periphery of the rotational shaft 122A in a fin form, and are also provided in a helical shape (screw shape) along an axial direction of the rotational shaft 122A.

Note that, the formation direction (swirl direction) is different between the ridge portions 122B located closer to the first transporting mechanisms 110 with reference to the discharge outlet 121A and the ridge portions 122B located closer to the discharging part 170 with reference to the discharge outlet 121A. The ridge portions 122B located closer to the first transporting mechanisms 110 with reference to the discharge outlet 121A are formed to be left-handed toward the first transporting mechanism 110. On the other hand, the ridge portions 122B located closer to the discharging part 170 with reference to the discharge outlet 121A are formed to be right-handed toward the first transporting mechanism 110. Accordingly, in the present exemplary embodiment, the single (common) transporting member 122 may perform the transportation of the waste toner from the discharging part 170 to the discharge outlet 121A and the transportation of the waste toner from the first transporting mechanism 110 to the discharge outlet 121A.

Referring back to FIG. 2 again, the transporting mechanism 100 will be still further described.

In the present exemplary embodiment, the first transporting mechanisms 110 (denoted by 110T and 110P in FIG. 2) corresponding to the respective image forming units 30T and 30P, which form toner images of spot colors or the like, are provided downstream, in the transporting direction of the waste toner, of the first transporting mechanisms 110 corresponding to the respective image forming units 30Y, 30M, 30C, and 30K which form yellow, magenta, cyan, and black toner images, respectively. Note that, in the present specification, the first transporting mechanisms 110 corresponding to the respective image forming units 30T, 30P, 30Y, 30M, 30C, and 30K will be referred to as first transporting mechanisms 110T, 110P, 110Y, 110M, 110C, and 110K, respectively.

A description will be further continued. The first transporting mechanisms 110Y, 110M, 110C, and 110K are connected to the tubular member 121 (recovery path) of the second transporting mechanism 120 on the upstream side in the transporting direction of the waste toner. Moreover, the first transporting mechanisms 110T and 110P are connected to the tubular member 121 at positions downstream of the above four first transporting mechanisms 110 in the transporting direction of the waste toner.

Here, for example, the first transporting mechanisms 110T and 110p may be connected to the tubular member 121 at positions upstream of the first transporting mechanisms 110Y, 110M, 110C, and 110K (hereinafter, sometimes referred to as the "first transporting mechanisms 110Y and the like") in the transporting direction of the waste toner.

In each of the image forming units 30T and 30P corresponding respectively to the first transporting mechanisms 110T and 110P, a toner image (a solid image) having the same area as that of a paper sheet may be sometimes formed, for example, by using a toner (a clear toner) that improves a gloss, for the purpose of improving the gloss of the paper sheet. Moreover, in some cases, in each of the image forming units 30T and 30P, a toner that improves transferability may be used for the purpose of improving the transferability, to the paper sheet, of yellow, magenta, cyan, and black toner images (for the purpose of improving the peeling performance of the yellow toner image and the like from the intermediate transfer belt 41), while an image having the area equivalent to that of the paper sheet and serving as a base for the yellow, magenta, cyan, and black toner images may be formed.

In other words, an image that probably causes the amount of waste toner to increase may be formed in some cases in each of the image forming units 30T and 30P corresponding respectively to the first transporting mechanisms 110T and 110P.

For this reason, if the first transporting mechanisms 110T and 110P are connected to the tubular member 121 at positions upstream of the first transporting mechanisms 110Y and the like in the transporting direction of the waste toner, a large amount of waste toner may be discharged into the tubular member 121 in a region upstream of the first transporting mechanisms 110Y and the like in the transporting direction of the waste toner. By contrast, if the image forming units 30T and 30P are not mounted, the waste toner is not discharged in the region upstream of the first transporting mechanisms 110Y and the like in the transporting direction of the waste toner. Accordingly, if the image forming units 30T and 30P are mounted, the amount of waste toner may increase at the locations where the waste toner is discharged into the tubular member 121 from the first transporting mechanisms 110Y, 110M, 110C, and 110K. If the image forming units 30T and 30P are not mounted, the amount of waste toner decreases at the above-described locations where the waste toner is discharged. In other words, the amount of waste toner at the above-described locations where the waste toner is discharged varies depending on whether or not the image forming units 30T and 30P are mounted.

In addition, consider the case where the first transporting mechanisms 110T and 110P are connected to the tubular member 121 at positions upstream of the first transporting mechanisms 110Y and the like in the transporting direction of the waste toner, so that a large amount of waste toner is discharged into the tubular member 121 at the positions. In this case, the discharge of waste toner into the tubular member 121 from the first transporting mechanisms 110Y, 110M, 110C, and 110K may possibly be limited. Specifically, the discharge of waste toner from the first transporting mechanisms 110Y, 110M, 110C and 110K located downstream of the first transporting mechanisms 110T and 110P may be limited, if the first transporting mechanisms 110 corresponding to the image forming units 30, such as the image forming units 30T and 30P, which may produce a large amount of waste toner, are connected to the tubular member 121 on the upstream side in the transporting direction of the waste toner. In order to prevent such limitation of the discharge, it is conceivable, for example, that the rotation number of the transporting member 122 be increased, or that the transport capacity of the second transporting mechanism 120 be increased. In such a case, however, if the image forming units 30T and 30P are not mounted, the transporting mechanism having a capacity more than necessary is provided. In addition, such approach of enhancing the transport capacity for the image forming units 30T and 30P, which is less frequently used than the image forming units 30Y, 30M, 30C, and 30K, may not be appropriate from the view point of cost or the like.

For these reasons, in the present exemplary embodiment, the first transporting mechanisms 110T and 110P are connected to the tubular member 121 at the positions downstream of the first transporting mechanisms 110Y, 110M, 110C, and 110K in the transporting direction of the waste toner.

As described above, the amount of waste toner is large in the image forming unit 30 having the toner that improves a gloss or in the image forming unit 30 having the toner that improves transferability, and consequently affects the discharge of waste toner in the first transporting mechanisms 110 located downstream. For this reason, it is preferable that such an image forming unit 30 that may produce a large amount of waste toner as the image forming unit 30 having the toner that improves a gloss or the image forming unit 30 having the toner that improves transferability be located in a portion corresponding to the first transporting mechanism 110 that discharges waste toner at the most downstream side in the transporting direction of the waste toner. In short, such an image forming unit is preferably mounted at the position corresponding to the first transporting mechanism 110T. Specifically, the image forming unit 30 having the toner that improves a gloss, or the like is preferably mounted at the position of the image forming unit 30T shown in FIG. 1.

Here, consider, for example, the case where the image forming unit 30 having the toner that improves a gloss or the like is mounted at not the position corresponding to the first transporting mechanism 110T but the position corresponding to the first transporting mechanism 110P. In this case, a process in which the image forming operation is not executed even upon receipt of an image-formation start instruction may be performed, for example. In other words, when the amount of waste toner transported from the first transporting mechanism 110P becomes larger than the amount of waste toner transported from the first transporting mechanism 110T, the process in which the image forming operation is not executed even upon receipt of the image-formation start instruction may be performed.

Moreover, for example, an instruction to change the position of the image forming unit 30 (an instruction to change the position of the image forming unit 30 from the position corresponding to the first transporting mechanism 101P to the position corresponding to the first transporting mechanism 110T) may be inputted through the UI 23 (see FIG. 1). Note that, determination as to whether or not the image forming unit 30 having the toner that improves a gloss, or the like is mounted at the position corresponding to the first transporting mechanism 110P may be made on the basis of information stored in an electrically erasable and programmable ROM (EEPROM) installed in the image forming unit 30, for example.

In addition, the present exemplary embodiment employs a configuration in which the waste toner from the discharging part 170 does not join the waste toner discharged from the first transporting mechanisms 110 and transported to the discharge outlet 121A. More specifically, as shown in FIG. 4, the present exemplary embodiment employs a configuration in which the waste toner from the discharging part 170 is received at the position leftward of the discharge outlet 121A, while the waste toner from the first transporting mechanisms 110 is received at the positions rightward of the discharge outlet 121A. In other words, the transport path for transporting waste toner to the third transporting mechanism 130 is divided into two separate transporting paths, that is, a first transport path for transporting waste toner from the first transporting mechanisms 110 to the third transporting mechanism 130 and a second transport path for transporting waste toner from the discharging part 170 to the third transporting mechanism 130. Further, the present exemplary embodiment employs a configuration in which the waste toner from the discharging part 170 is transported to the third transporting mechanism 130 through the transport path different from that through which the waste toner is transported from the first transporting mechanisms 110 to the third transporting mechanism 130.

Since the waste toner is transported to the discharging part 170 from the belt cleaner 45, the amount of waste toner discharged from the discharging part 170 tends to be large. Employing a configuration in which the waste toner from the discharging part 170 is caused to join the waste toner from the first transporting mechanisms 110 may lead to an increase in size of the apparatus due to, for example, an increase in diameter of the tubular member 121. Moreover, employing the configuration in which the waste toner from the discharging part 170 is caused to join the waste toner from the first transporting mechanism 110 may probably cause the clogging of waste toner inside the tubular member 121, for example. Accordingly, the present exemplary embodiment employs a configuration in which the waste toner from the discharging part 170 is caused, not to join the waste toner discharged from the first transporting mechanism 110, but to be directly transported to the third transporting mechanism 130.

Moreover, n the present exemplary embodiment, a falling distance with which the waste toner falls down from the discharging part 170 to the tubular member 121 of the second transporting mechanism 120 (see H in FIG. 2) is made shorter than a falling distance with which the waste toner falls down in the first transporting mechanism 110. In other words, the height of the discharging part 170 from the tubular member 121 is made shorter than the height of a discharging part for the waste toner in the first transporting mechanism 110 (a discharging part for the waste toner transported by the transporting member 341 (see FIG. 1)) from the tubular member 121.

As described above, the amount of waste toner discharged from the discharging part 170 tends to be large. In addition, no such a member as the coil spring 112 in the first transporting mechanism 110 is provided at the lower part of the discharging part 170. For these reasons, the clogging and the like of waste toner are likely to occur in the lower part of the discharging part 170. In this respect, in the present exemplary embodiment, the falling distance with which the waste toner falls down from the discharging part 170 to the tubular member 121 is made further small. Specifically, the present exemplary embodiment has a configuration in which the discharging part 170 is disposed to a position closer to the transporting member 122 in the tubular member 121, so that the clogging and the like of waste toner are prevented by the transporting member 122 rotationally driven. Note that, in the present exemplary embodiment, the transport path for the waste toner, formed by the tubular member 111 in the first transporting mechanism 110Y, may be taken as a first falling-down transport path. In addition, the transport path for the waste toner, formed by the tubular member 111 in the first transporting mechanism 110P, may be taken as a second falling-down transport path. Moreover, the transport path for the waste toner from the discharging part 170 to the tubular member 121 may be taken as a third falling-down transport path.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that includes a first image forming part forming a toner image by using an image forming unit to be mounted, and a second image forming part forming a toner image by using an image forming unit to be mounted, the first image forming part and the second image forming part being inhibited from forming respective toner images if an image forming unit is not mounted to the first image forming part, the first image forming part being allowed to form a toner image if an image forming unit is mounted to the first image forming part while an image forming unit is not mounted to the second image forming part; and a transporting section that includes a first receiving part receiving waste powder discarded by the first image forming part, and a second receiving part receiving waste powder discarded by the second image forming part, and that transports the waste powder thus received, wherein the first image receiving part receives waste powder from at least any one of a yellow toner image, a magenta toner image, a cyan toner image, and a black toner image, and the second receiving part receives waste powder from other than the yellow toner image, the magenta toner image, the cyan toner image, and the black toner image, the second receiving part of the transporting section being provided downstream of the first receiving part in a transporting direction of the waste powder, a yellow-color image forming unit, a magenta-color image forming unit, a cyan-color image forming unit and a black-color image forming unit are mounted to the first image forming part, an image forming unit other than the yellow-color image forming unit, the magenta-color image forming unit, the cyan-color image forming unit and the black-color image forming unit is mounted to the second image forming part, and any image formation is inhibited if the yellow-color image forming unit, the magenta-color image forming unit, the cyan-color image forming unit and the black-color image forming unit are not mounted to the first image forming part.

2. The image forming apparatus according to claim 1, further comprising a transfer section that transfers, onto a recording medium, the toner image formed by the first image forming part and the toner image formed by the second image forming part, wherein an image forming unit that forms a toner image giving a gloss to the recording medium is mountable to the second image forming part.

3. The image forming apparatus according to claim 1, further comprising a transferring member onto which the toner image formed by the first image forming part and the toner image formed by the second image forming part are transferred, the transferring member transferring, onto a recording medium, the toner image formed by the first image forming part, wherein an image forming unit is mountable to the second image forming part, the image forming unit forming a toner image that improves transferability at a time when the toner image formed by the first image forming part and transferred onto the transferring member is transferred onto the recording medium from the transferring member.

4. The image forming apparatus according to claim 1, further comprising a controller, wherein the image forming section further includes a third image forming part that forms a toner image by using an image forming unit to be mounted, the first image forming part being allowed to form a toner image if the image forming unit is mounted to the first image forming part while the image forming unit is not mounted to the third image forming part, the transporting section further includes a third receiving part provided downstream of the second receiving part in the transporting direction of the waste powder, the third receiving part receiving waste powder discarded by the third image forming part, and the controller inhibits the formation of toner images by the image forming section when an amount of waste powder to be discarded by the second image forming part exceeds an amount of waste powder to be discarded by the third image forming part.

5. The image forming apparatus according to claim 1, further comprising:

a transport path that is provided in the transporting section and is used to transport the waste powder received by the first receiving part and the waste powder received by the second receiving part;

a second transport path through which waste powder discharged from the transport path of the transporting section is transported; and a transferring member onto which toner images formed by the first image forming part and the second image forming part are transferred, the transferring member transferring, onto a recording medium, the toner images thus transferred, wherein waste powder from the transferring member is transported to the second transport path via a different transport path from the transport path of the transporting section.

6. The image forming apparatus according to claim 1, further comprising:

a transferring member onto which toner images formed by the first image forming part and the second image forming part are transferred, the transferring member transferring, onto a recording medium, the toner images thus transferred; and a transporting member, wherein the transporting section includes a transport path that is used to transport the waste powder received by the first receiving part and the waste powder received by the second receiving part, the transport path of the transporting section further includes:

a transfer-member receiving part that receives waste powder from the transferring member; and a discharging part that is provided between the second receiving part and the transfer-member receiving part, and that discharges the waste powder in the transport path, the transporting member is provided along the transport path, and transports the waste powder in the transport path to the discharging part, and the transporting member is configured so that the waste powder received by the first receiving part and the waste powder received by the second receiving part as well as the waste powder received by the transfer-member receiving part are allowed to be transported to the discharging part.

7. The image forming apparatus according to claim 1, further comprising:

a transferring member onto which toner images formed by the first image forming part and the second image forming part are transferred, the transferring member transferring, onto a recording medium, the toner images thus transferred;

a first falling-down transport path;

a second falling-down transport path; and a third falling-down transport path, wherein the transporting section includes:

a transport path that is used to transport the waste powder received by the first receiving part and the waste powder received by the second receiving part;

a transfer-member receiving part that is provided in the transport path, and that receives waste powder from the transferring member; and a transporting member that is provided in the transport path, and that transports the waste powder in the transport path, the first falling-down transport path allows the waste powder from the first image forming part to fall down, and thus transfers the waste powder to the first receiving part, the second falling-down transport path allows the waste powder from the second image forming part to fall down, and thus transfers the waste powder to the second receiving part, the third falling-down transport path allows the waste powder from the transferring member to fall down, and thus transfers the waste powder to the transfer-member receiving part, and a falling distance with which the waste powder in the third falling-down transport path falls down is shorter than a falling distance with which the waste powder in the first falling-down transport path falls down and than a falling distance with which the waste powder in the second falling-down transport path falls down.

8. A waste powder transporting method of an image forming apparatus including: an image forming section that includes a first image forming part forming a toner image by using an image forming unit to be mounted, and a second image forming part forming a toner image by using an image forming unit to be mounted, and a transporting section that includes a first receiving part receiving waste powder discarded by the first image forming part, and a second receiving part receiving waste powder discarded by the second image forming part, wherein the first image receiving part receives waste powder from at least any one of a yellow toner image, a magenta toner image, a cyan toner image, and a black toner image, and the second receiving part receives waste powder from other than the yellow toner image, the magenta toner image, the cyan toner image, and the black toner image, and that transports the waste powder thus received, the waste powder transporting method comprising:

inhibiting the first image forming part and the second image forming part from forming respective toner images if an image forming unit is not mounted to the first image forming part;

allowing the first image forming part to form a toner image if an image forming unit is mounted to the first image forming part while an image forming unit is not mounted to the second image forming part;

providing the second receiving part of the transporting section downstream of the first receiving part in a transporting direction of the waste powder;

a yellow-color image forming unit, a magenta-color image forming unit, a cyan-color image forming unit and a black-color image forming unit are mounted to the first image forming part, an image forming unit other than the yellow-color image forming unit, the magenta-color image forming unit, the cyan-color image forming unit and the black-color image forming unit is mounted to the second image forming part, and any image formation is inhibited if the yellow-color image forming unit, the magenta-color image forming unit, the cyan-color image forming unit and the black-color image forming unit are not mounted to the first image forming part.

9. An image forming apparatus comprising:

an image forming section that includes a first image forming part forming a toner image by using a first image forming unit to be mounted and a second image forming part forming a toner image by using a second image forming unit to be mounted and a third image forming part that forms a toner image by using an image forming unit to be mounted, wherein the first image forming part forms at least one of a yellow toner image, a magenta toner image, a cyan toner image, and a black toner image, and the second image forming part forms other than the yellow toner image, the magenta toner image, the cyan toner image, and the black toner image; and the third image forming part forms other than images formed by the first image forming part and the second image forming part; and a waste powder transporting section that includes a first receiving part that receives a waste powder discharged from the first image forming part, and a second receiving part that receives a waste powder discharged from the second image forming part, a third receiving part that receives a waste powder discarded by the third image forming part, wherein the second receiving part being provided downstream of the first receiving part in a transporting direction of the waste powder; and the third receiving part being provided down stream of the second receiving part in the transporting direction of the waste powder.

10. The image forming apparatus according to claim 9, wherein the first receiving part receives a waste powder discharged from a black toner image forming unit that is upstream of other image forming units in the transporting direction of the waste powder.

* * * * *